US007096938B2

(12) United States Patent
Carmody et al.

(10) Patent No.: US 7,096,938 B2
(45) Date of Patent: Aug. 29, 2006

(54) SLIP ENERGIZED BY LONGITUDINAL SHRINKAGE

(75) Inventors: Michael A. Carmody, Houston, TX (US); Robert S. O'Brien, Katy, TX (US)

(73) Assignee: Baker-Hughes Incorporated, Houston, TX (US)

( * ) Notice: Subject to any disclaimer, the term of this patent is extended or adjusted under 35 U.S.C. 154(b) by 201 days.

(21) Appl. No.: 10/441,521

(22) Filed: May 20, 2003

(65) Prior Publication Data

US 2004/0231838 A1 Nov. 25, 2004

(51) Int. Cl.
*E21B 23/01* (2006.01)

(52) U.S. Cl. ..... 166/134; 166/207; 166/217

(58) Field of Classification Search ..... 166/134, 166/217, 206, 207, 187
See application file for complete search history.

(56) References Cited

U.S. PATENT DOCUMENTS 2,159,640 A * 5/1939 Strom ..... 166/122
2,420,226 A * 5/1947 Claus ..... 277/341
2,652,894 A * 9/1953 Brown et al. ..... 166/134
3,097,696 A * 7/1963 Orr ..... 166/135
3,155,164 A * 11/1964 Keener ..... 166/63
3,238,821 A * 3/1966 Coulter ..... 408/11
3,280,916 A * 10/1966 Barrington ..... 166/148
3,921,720 A * 11/1975 Wetzel ..... 166/387
3,948,321 A * 4/1976 Owen et al. ..... 166/277
5,220,959 A * 6/1993 Vance, Sr. ..... 166/187
5,542,473 A * 8/1996 Pringle ..... 166/120
6,098,717 A 8/2000 Bailey et al.
6,325,148 B1 * 12/2001 Trahan et al. ..... 166/297
6,513,600 B1 * 2/2003 Ross ..... 166/387
6,591,905 B1 * 7/2003 Coon ..... 166/117.6

FOREIGN PATENT DOCUMENTS

WO WO 00/66877 11/2000
WO WO 03/023186 A1 3/2003

* cited by examiner

*Primary Examiner*—Hoang Dang
(74) *Attorney, Agent, or Firm*—Steve Rosenblatt

(57) ABSTRACT

A slip for an expanding hanger or patch is disclosed. The slip is mounted over the hanger body and has an internal profile that nests within a mating profile on the exterior of the hanger. When a compressive force is applied to the hanger, it shrinks longitudinally and as a result the slip is cammed radially to the extent the inside diameter of the surrounding tubing permits. When the swage is advanced, the diameter of the hanger increases forcing the slip into preferably penetrating contact with the inside wall of the surrounding tubular.

14 Claims, 4 Drawing Sheets

SLIP ENERGIZED BY LONGITUDINAL SHRINKAGE

FIELD OF THE INVENTION

The field of this invention is expanding tubulars and more particularly a gripping system for hangers or patches that is energized by longitudinal dimension change of the tubular induced by the expansion process.

BACKGROUND OF THE INVENTION

When downhole tubulars crack or otherwise need repair, patches or cladding are inserted to the proper depth and expanded into contact over the damaged area. As a result of expansion, the cladding assumes a sealed relation with the surrounding tubular. In other applications a hanger attached to a tubular string is inserted into a larger tubular. Expansion is used to anchor and seal the newly inserted string to the existing string.

Expansion is accomplished by driving a swage through the hanger or cladding. Applied hydraulic pressure from the surface is used to stroke a piston, which, in turn, drives the swage. An anchor assembly initially is energized to hold the hanger in response to applied pressure. Initially, the running tool that delivered the hanger is released when the anchor grabs the hanger to provide support for the hanger as the piston strokes the swage to obtain initial support. Once initial support is accomplished the anchor is released and the stroker for the swage is re-cocked for a repetition of the process until the swage passes through the hanger.

The specification for the tubular being repaired or the tubular in which the hanger is to be attached can vary widely. The condition of that tubular can also affect its internal diameter.

When using a swage that has a fixed dimension care must be taken to properly size it for the anticipated inside diameter where the patch or hanger is to be attached. The problem is that there is uncertainty as to the actual inside diameter after years of service. Additionally, a given swage size may be used for a variety of casing weights of a given size. If the actual diameter is smaller than anticipated, there may not be enough available force in the stroking mechanism for the swage to drive it through. In this case the swage will stall and the expansion cannot be properly completed without time-consuming trips out of the hole and replacement swages. Even worse, the swage could hang up in the hanger if it can't be driven all the way through.

One expensive way around this is to use a variable diameter swage that has the ability to change dimension in response to unexpected inside diameter dimension in the tubular in which the patch or hanger is to be attached. Fixed diameter swages are more economical and, in the past, some efforts have been made when using a fixed swage to compensate for unexpected variation from the planned inside diameter. FIGS. 1 and 2 show a prior technique for compensating for dimensional variations in the casing Referring to FIG. 1, a fixed diameter swage 10 is disposed inside the hanger or cladding 12 and the entire assembly is in position for expansion inside casing 14. When hanger is mentioned it will be considered to also encompass other downhole structures such as patches or cladding. Hanger 12 has an exterior serrated surface 16 built into it for eventual engagement with the casing 14, as shown in FIG. 2. An inner sleeve 18 made of soft material underlays the serrations 16. The intent is for the swage 10 to go inside sleeve 18. If the inside diameter turns out to be smaller than anticipated, then the swage 10 will deform sleeve 18 by design. This can happen because sleeve 18 is made deliberately soft. The objective is to prevent the swage from stalling when the inside diameter of the casing turns out to be smaller than expected. Using sleeve 18 also helps to give the swage 10 an opportunity to provide sufficient contact force against casing 14 by the serrations 16 when the actual inside diameter turns out to be somewhat larger than expected. Yet the ability to provide flexibility and latitude for the actual inside diameter being smaller or larger than anticipated is limited in this design. The apparatus of the present invention seeks to provide greater latitude for diameter variations in both directions that may be incurred in the field. Additionally, the present invention seeks to improve the grip and provide resistance against release from net forces in opposed directions. One way this is accomplished is to take advantage of the phenomenon of longitudinal dimension change of the hanger under compressive or tensile stress that occurs as force is applied to drive the swage. The slip is articulated for radial extension from longitudinal shrinkage to allow a greater variation of inside diameters in which a proper grip can be maintained and the swage driven through without stalling. These and other advantages of the present invention will be more readily appreciated by those skilled in the art from a review of the description of the preferred embodiment and the claims, which appear below.

SUMMARY OF THE INVENTION

A slip for an expanding hanger or patch is disclosed. The slip is mounted over the hanger body and has an internal profile that nests within a mating profile on the exterior of the hanger. When the swage is forced through the hanger, the hanger shrinks longitudinally and as a result the slip is cammed radially to the extent the inside diameter of the surrounding tubing permits. As the swage is further advanced, the diameter of the hanger increases in the region where longitudinal dimension change has already taken place forcing the slip into preferably penetrating contact with the inside wall of the surrounding tubular.

DETAILED DESCRIPTION OF THE PREFERRED EMBODIMENT

Figure 6A:
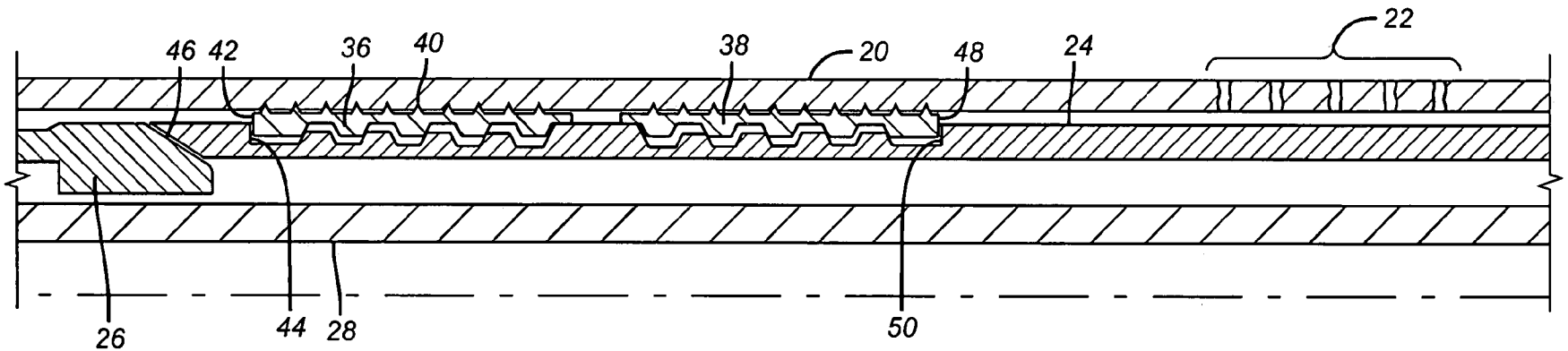
FIGS. 6*a*–6*b* shows the upper end of a hanger in the set position with slips disposed in mirror image orientation.
Figure 6B:
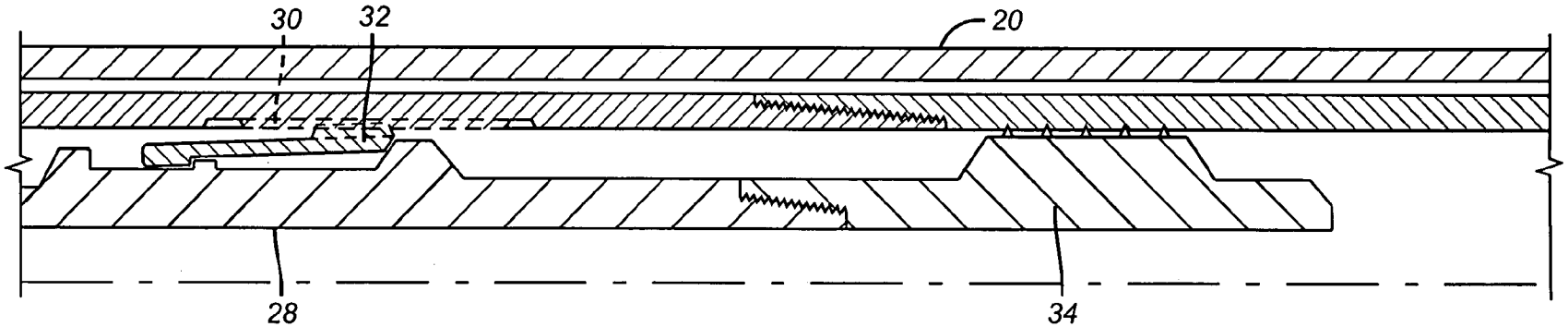

The overall layout can best be understood from FIG. 6. The casing 20 has a split or an area of perforation 22 that needs to be covered with the hanger 24. Alternatively, hanger 24 may be mounted at the uphole end of a tubing string (not shown) such that when it is expanded by the swage 26 the final result is support for the string from the casing 20. Swage 26 has a fixed diameter and is mounted for sliding movement with respect to running tool 28. Hanger 24 has a groove 30 into which a latch 32 on the running tool 28 is initially held. In this manner, a running string (not shown) can support the hanger 24 for proper placement in the casing 20. Generally, the swage 26 is driven by a hydraulic stroker device (not shown). Initially, application of hydraulic pressure through the running string actuates the schematically illustrated anchor 34 for an initial grip of the hanger 24. After some advancement of the swage 26 a grip is established between the hanger 24 and the casing 20, as will be described below. Such expansion of the hanger 24 also results in a release of latch 32 from groove 30. Thereafter, by cycles of applying and removing the hydraulic pressure, the swage 26 is advanced until it clears the opposite end of the hanger 24. Those skilled in the art will appreciate that the anchor 34 can be mounted downhole of the swage 26 (as shown) or uphole of the swage 26 and still obtain sequential grips to allow repeated stroking to advance the swage 26 to its desired end of travel. The above-described technique for stepwise advancement of a fixed diameter swage 26 is a known procedure and sets the stage for the detailed description of the operation of the invention.

It should be noted that in FIG. 6, the swage 26 is bearing down and initiating expansion by fixating the uphole end of hanger 24. The lower end of hanger 24 is not restrained but merely held by the anchor 34. The swage actually puts the hanger 24 in tension. For a diameter expansion of about 20% the length will decrease by about 5%. Alternatively, the swage can be forced in an uphole direction with the upper end of the hanger 24 being retained. In this situation, the hanger 24 will be in compression and the wall thickness will try to remain constant. Since the volume will remain constant after expansion, the length will shrink even more than expansion under tension. It is this change in length, as the expansion is underway that is employed in the present invention to push out the slips such as 36 and 38 to the wall of the casing across clearance 66, if present. This use of longitudinal dimension change to drive the slip allows for greater flexibility to have the hanger 24 get a bite in a wider range of casing inside diameters than was possible in the prior designs.

Broadly stated, one aspect of the invention is the ability to take advantage of the longitudinal shrinkage of the hanger 24, when placed under compressive or tensile stress from swaging.

FIG. 6*a* illustrates slips 36 and 38. Slip 36 has serrations or other surface treatment 40 so that upon expansion it can preferably penetrate into the wall of the casing 20. The surface treatment 40 can also incorporate hard materials such as carbide inserts or it can be a regular pattern of protrusions or a series of rings or a thread or any other grip enhancing treatment or coating of the exterior of the slip 36. Slip 36 is preferably a split ring with a single split longitudinally. Alternatively, the slip 36 can be a plurality of segments held to hanger 24 with a band spring or other retainer that can allow the segments to be cammed outwardly as will be described below. In another form, slip 36 can be a solid thin walled ring that can be cammed out if space permits by simply yielding or by fracturing. In the preferred embodiment slip 38 is identical to slip 36 and is installed in a mirror image manner. As seen in FIG. 6*a*, slip 36 has a shoulder 42 adjacent to a mating shoulder 44 near the uphole end 46 of hanger 24. Slip 38 is identical but is oppositely oriented so that it has a shoulder 48 near shoulder 50 on hanger 24. Shoulder 48 is oriented closer to the downhole end of hanger 24. While two mirror image slips 36 and 38 have been shown near one end of hanger 24, those skilled in the art will appreciate that slips 36 and 38 can be in the same as opposed to mirror image orientation. Only one slip such as 36 or 38 can be used or even more than the two slips shown can be placed near a given end of the hanger 24. The design of each slip can vary and some variations are suggested above. These variations can be mixed or matched.

Figure 3:
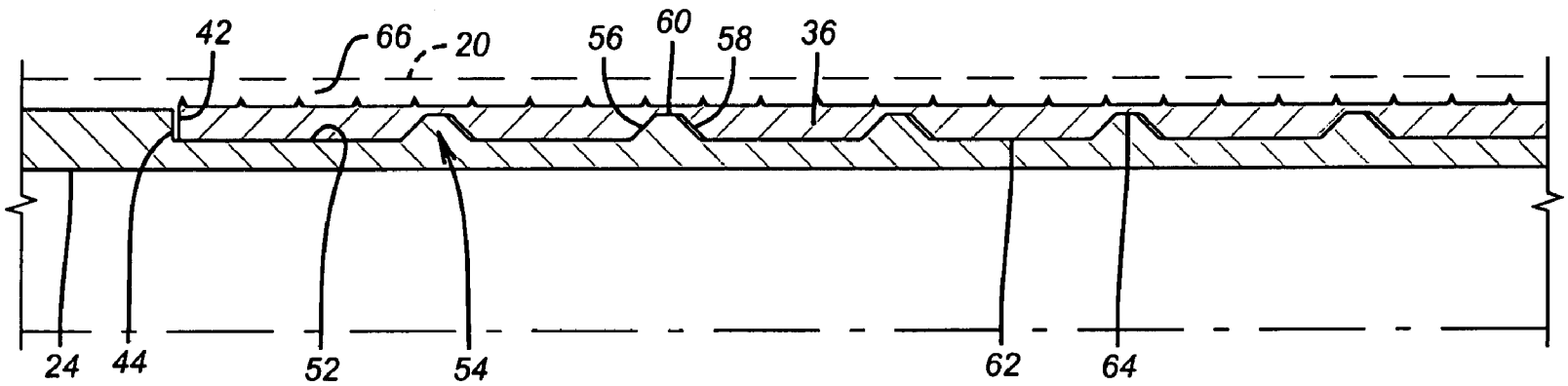
FIG. 3 is a run in view of a part of a hanger showing the distinct slip and the camming mechanism.
Figure 5:
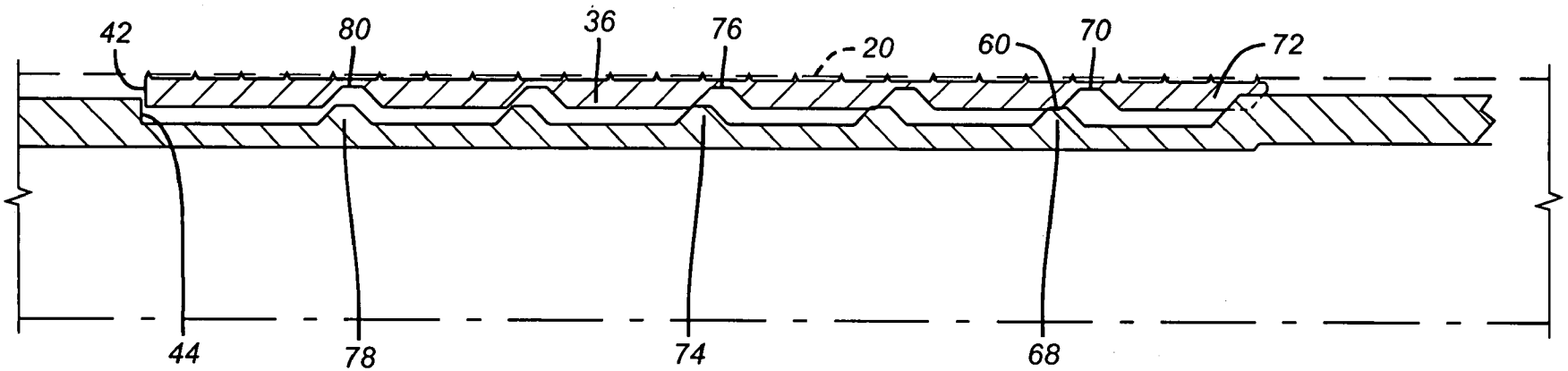
FIG. 5 is the view of FIG. 3 after the slip has had room inside the tubular inside diameter to be cammed out before being forced against the wall of the surrounding tubular.

FIG. 3 illustrates a portion of slip 36 with the casing 20 represented by a dashed line. Shoulder 42 is disposed close to shoulder 44 on hanger 24. Hanger 24 has a recessed surface 52 that begins at shoulder 42 and a plurality of projections 54. Typically, a projection 54 is trapezoidal in section and has opposed surfaces 56 and 58 that have intersecting slopes. In between is a preferably flat surface 60. Slip 36 has an interior surface 62 with voids 64 that preferably conform in shape to projections 54. Shape conformity is merely the preferred mode and is not essential. The indicated shape using inclined surfaces separated by a flat surface for the projections 54 or for conforming voids 64 is simply the preferred embodiment. Those skilled in the art will appreciate that the invention encompasses shapes that can nest during run in, as shown in FIG. 3 to allow a clearance 66 to exist. Then, when swage 26 begins moving into hanger 24 its length will decrease and to the extent a clearance 66 still exists, the nesting relation turns into a camming relationship as the slip 36, or for that matter any other similarly mounted slip, is moved outwardly due to longitudinal shrinkage of the hanger 24 under stress loading. For example, if the planned expansion is about 20% the longitudinal shrinkage is approximately 5%. As shown in FIG. 5, the further a given projection is from a point on the hanger 24 that is restrained the greater the offset between previously nested pairs of projection and corresponding depression. For example, projection 68 is fully misaligned from depression 70 so as to fully cam out the lower end 72 of slip 36. Further uphole, projection 74 is somewhat less misaligned from depression 76 while still further uphole projection 78 is separated from but virtually still in alignment with depression 80. FIG. 5 illustrates that where the inside diameter of the casing 20 permits, driving the swage 26 through hanger 24 will shorten it drawing the various projections about 5% of their original distance from the restrained point of the hanger 24. Initially, until shoulder 42 on slip 36 engages shoulder 44 on hanger 24 any slack between the projections and depressions will be taken out. Thereafter, as the projections keep moving, shortening their original distance from the restrained point by about 5% or more depending on the amount of diametric expansion, due to longitudinal shrinkage the camming action commences to the extent a clearance to the inside casing wall is present. The maximum radial displacement due to shrinkage of the hanger 24 is shown in FIG. 5. It happens when flat surface 60 is on interior surface 62 of the slip 36. While the preferred embodiment has been shown with projections on the hanger 24 and nesting depressions on the slip 36, those skilled in the art will appreciate that the desired camming action can occur by presenting the projections on the slip 36 and the nested depressions on the hanger 24. It is only after the camming action described above, which occurs due to shrinkage of the hanger 24 from the swage 26 moving through it, that the swage 26 can force the slip 36 into a preferably biting relation with the casing 20 through expansion of the diameter in the area of the slip 36. The camming of slip 36 begins before the diameter under it is actually expanded.

Figure 4:
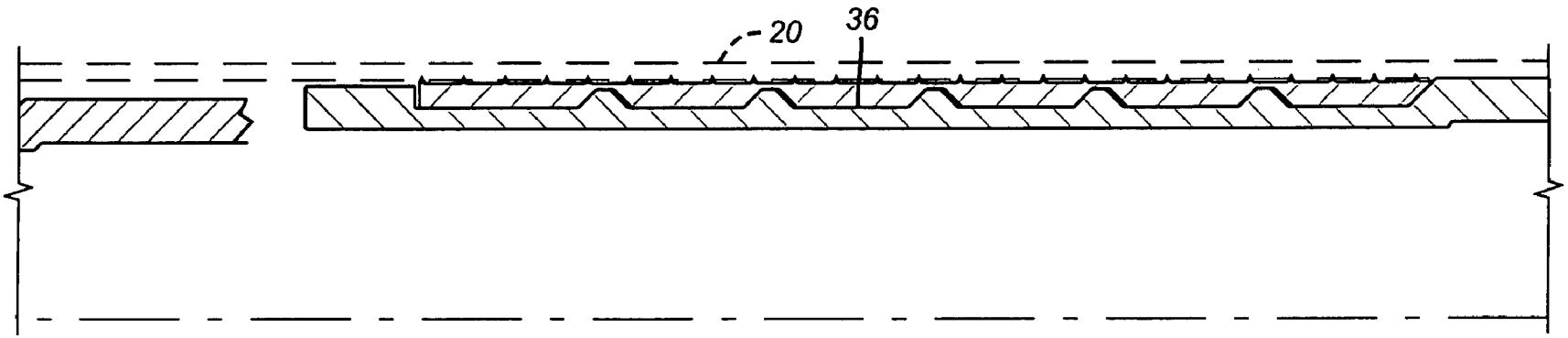
FIG. 4 is the view of FIG. 3 with the slip set in the surrounding tubular without an opportunity to be cammed away from the hanger.

One extreme is illustrated in FIG. 4 where the inside wall of the casing 20 is so close to slip 36 that camming action cannot occur. In this case, the applied stress that would otherwise result in longitudinal shrinking of the hanger 24 instead merely reduces the wall thickness of the hanger 24 since the slip 36 acts to fixate its end as the expansion begins.

While the preferred method described above is to longitudinally shrink the hanger 24 those skilled in the art will appreciate that it is the camming action caused by relative movement that results in the ability of the hanger 24 to compensate for inside diameters of the casing 20. Thus any technique that results in a camming action to move a slip such as 36 outwardly, up to the point of closing an available clearance, where the camming takes place before the diameter under the slip is actually expanded, is within the scope of the invention, whether the camming is caused by shrinkage or growth of one member with respect to another or induced by other techniques.

Those skilled in the art will appreciate that the lower end (not shown) of the hanger 24 can be similar to what has been illustrated for a slip layout in FIG. 6. Alternatively, the slip arrangements can be different at opposing ends or slips can be used on only one end and still be within the scope of the invention.

After expansion, a net uphole directed dislodging force pushes shoulder 42 of slip 36 against shoulder 44 of hanger 24 to help the slip 36 dig in better to resist such force. In the opposite direction, the engagement between shoulders 48 and 50 also helps slip 38 retain its grip. In general, during the camming action, shoulder engagement between a slip and the hanger 24 converts what may have previously been longitudinal displacement into radially cammed movement.

Figure 1:
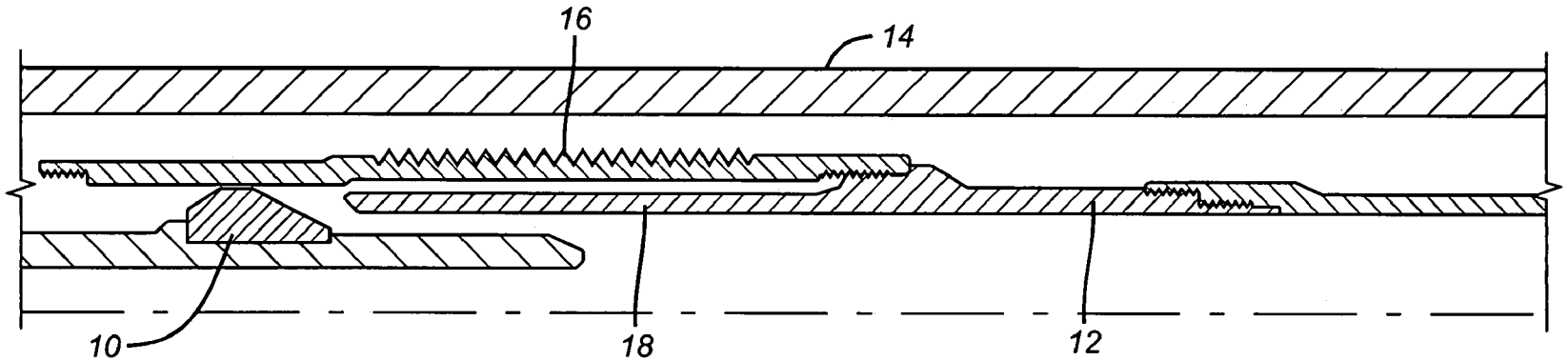
(PRIOR ART) FIG. 1
FIG. 1 is a run in view of a prior art hanger.
Figure 2:
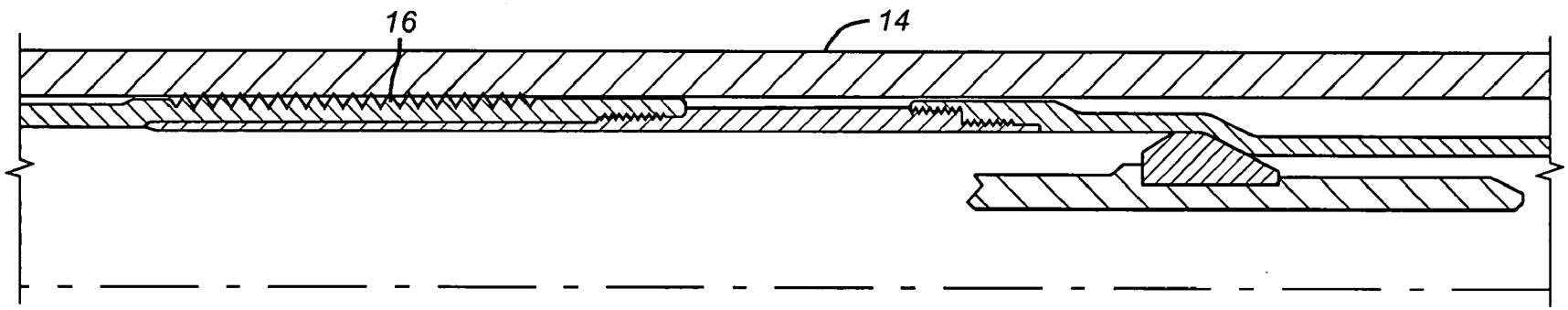
(PRIOR ART) FIG. 2
FIG. 2 is the view of FIG. 1 in the set position.

Those skilled in the art will now appreciate that the present invention with slips that can be cammed out, or not, depending on the inside diameter of the casing 20, allows the apparatus a greater flexibility to obtain the proper grip in a broader range of casing inside diameters than the prior designs such as shown in FIGS. 1 and 2. The radial range of camming is flexible from none to a maximum value where the slip is fully cammed out as a result of complete misalignment between a previously nested projection and depression or whatever the outer limit of the camming mechanism that is used due to the available relative movement. Optionally, resilient seals can be employed with the slips to enhance the sealing against the casing 20.

The above description is illustrative of the preferred embodiment and many modifications may be made by those skilled in the art without departing from the invention whose scope is to be determined from the literal and equivalent scope of the claims below:

We claim:

1. A downhole tool for engagement with an existing tubular downhole, comprising:

a body having a longitudinal axis and defining an innermost bore therethrough said innermost bore also being the innermost bore of the tool;

at least one slip mounted to said body, said body and slip insertable into the tubular downhole and defining a clearance therebetween, said slip actuated to move radially with respect to said longitudinal axis into initial or enhanced contact with the existing tubular in response to a longitudinal dimension change of said body resulting from stress from expansion of said body;

the length of said body is reduced to move said slip radially;

said slip is cammed radially when the length of said body is reduced.

2. The tool of claim 1, wherein:

said radial movement of said slips due to said camming is limited by said clearance.

3. A downhole tool for engagement with an existing tubular downhole, comprising:

a body having a longitudinal axis;

at least one slip mounted to said body, said body and slip insertable into the tubular downhole and defining a clearance therebetween, said slip actuated to move radially with respect to said longitudinal axis in response to a longitudinal dimension change of said body resulting from stress from expansion of said body;

the length of said body is reduced to move said slip radially;

said slip is cammed radially when the length of said body is reduced;

said slip and said body are engaged to each other using at least one projection on one of said body and said slip initially extending into at least one depression on the other of said body and said slip.

4. The tool of claim 3, wherein:

said body comprises at least one shoulder, that is engaged by said slip when said reduction of body length causes said projection to move toward a more misaligned position with respect to said depression.

5. The tool of claim 4, wherein:

wherein said body further comprises a recess, said slip is disposed substantially within said recess when said projection and depression are fully aligned.

6. The tool of claim 3, wherein:

the maximum amount of camming of said slip due to shrinkage in length of said body, when not limited by said clearance, is defined by fully misaligning said projection and said depression.

7. The tool of claim 4, wherein:

said slip comprises at least two slips and said shoulder comprises at least two shoulders, each said slip engaging a corresponding shoulder upon said longitudinal reduction in length of said body;

said slips and their corresponding shoulders are arranged on said body in mirror image orientation on said body.

8. The tool of claim 4, wherein:

said slip comprises at least two slips and said shoulder comprises at least two shoulders, each said slip engaging a corresponding shoulder upon said longitudinal reduction in length of said body;

said slips and their corresponding shoulders are arranged on said body in the same orientation on said body.

9. The tool of claim 3, wherein:

said at least one projection and said at least one depression comprise a plurality of paired projections and depressions.

10. The tool of claim 9, wherein:

said body comprises at least one shoulder that is engaged by said slip when said reduction of body length causes said projection to move toward a more misaligned position with respect to said depression;

said paired projections and depressions become more misaligned due to length reduction of said body, the further they are disposed from a fixed location on said body.

11. The tool of claim 4, wherein:

said shoulder, when contacted by said slip as the length of said body is reduced assists in forcing said projection into misalignment with said depression to move said slip radially.

12. The tool of claim 7, wherein:

said at least two slips comprise at least four slips with two arranged adjacent opposed ends of said body, whereupon expansion a portion of the downhole tubular is isolated.

13. The tool of claim 7, wherein:

said mirror image orientation of said shoulders provides support to one slip when applied loads to said body in a first direction, when supported by said slip from the downhole tubular, and to another slip when applied loads are in a second direction opposite said first direction.

14. The tool of claim 3, wherein:

said projection and depression have a generally trapezoidal cross-section further comprising generally parallel end surfaces such that, if sufficient clearance is initially available, said end surface of said depression on said slip exits said projection on said body and said slip obtains support off an inner surface resting on said end surface of said projection on said body.

* * * * *